United States Patent [19]

Awbrey

[11] Patent Number: 4,956,076

[45] Date of Patent: Sep. 11, 1990

[54] METHOD OF SCAVENGING HYDROGEN HALIDES FROM LIQUID HYDROCARBONACEOUS MEDIUMS

[75] Inventor: Spencer S. Awbrey, Spring, Tex.

[73] Assignee: Betz Laboratories, Inc., Trevose, Pa.

[21] Appl. No.: 414,049

[22] Filed: Sep. 28, 1989

[51] Int. Cl.[5] ..... C10G 7/10

[52] U.S. Cl. ..... 208/291; 208/474; 208/262.1; 208/262.5; 585/950; 585/864; 252/346; 210/109; 210/705; 210/723; 210/729

[58] Field of Search ..... 585/950; 208/47, 262.1, 208/291, 47; 252/396; 210/705, 723, 729

[56] References Cited

U.S. PATENT DOCUMENTS

| | | | |
|---|---|---|---|
| 2,415,161 | 2/1947 | Camp | 208/47 |
| 2,603,622 | 7/1952 | Berger et al. | 252/296 |
| 2,993,862 | 7/1961 | Monroe et al. | 252/396 |
| 2,993,863 | 7/1961 | Monroe et al. | 252/396 |
| 3,310,497 | 3/1964 | Hudson et al. | 252/396 |
| 3,375,460 | 5/1965 | Barbie | 208/262.1 |
| 3,400,171 | 9/1968 | Van Pool | 208/262.1 |
| 3,403,198 | 9/1968 | Van Pool | 208/262.1 |
| 3,413,237 | 11/1968 | Foroulis | 252/393 |
| 3,761,534 | 9/1973 | Sun et al. | 208/262.1 |
| 3,779,905 | 12/1973 | Stedman | 208/47 |
| 4,430,196 | 2/1984 | Niu | 208/47 |

*Primary Examiner*—Helane E. Myers

*Attorney, Agent, or Firm*—Alexander D. Ricci; Bruce E. Peacock

[57] ABSTRACT

Methods of scavenging hydrogen halide species from hydrocarbon liquids are disclosed. Preferred scavengers includes allyl alcohol, benzyl alcohol and tertiary alcohols such as tert-butyl alcohol.

16 Claims, No Drawings

METHOD OF SCAVENGING HYDROGEN HALIDES FROM LIQUID HYDROCARBONACEOUS MEDIUMS

FIELD OF THE INVENTION

The present invention pertains to methods for reducing the hydrogen halide content of various and sundry hydrocarbonaceous mediums.

BACKGROUND OF THE INVENTION

Petroleum hydrocarbon feedstocks such as petroleum crudes, gas oil, etc., are subjected to various processes in order to isolate and separate different fractions of the feedstock. For example, in refinery processes, the feedstock is distilled so as to provide light hydrocarbons, gasoline, naphtha, kerosene, gas oil, etc.

The lower boiling fractions are recovered as an overhead fraction from distillation zones. The intermediate components are recovered as side cuts from the distillation zones. The fractions are cooled, condensed, and sent to collecting equipment. No matter what type of petroleum feedstock is used as the charge, the distillation equipment is subject to the corrosive attack of various halide-based acids such as HCl.

HCl is probably the most troublesome corrosive material and may be formed by hydrolysis of calcium and magnesium chlorides originally present in the brines produced concomitantly with the feedstock.

Halide-based corrosion caused in such refinery systems may occur on the metal surfaces of fractionating such as crude towers, trays within the towers, heat exchangers, etc. The most troublesome locations for corrosion are the overhead of the distillation equipment which includes tower top trays, overhead lines, condensers and the top pump around exchangers. It is usually within these areas that water condensation is formed or is carried along with the process stream. The top temperature of the fractionating column is maintained close to or above the boiling point of water. The condensate formed after the vapor leaves the column may contain significant concentration of the halide-based acids mentioned above. This high concentration of acidic components renders the pH of the condensate highly acidic and, as such, dangerously corrosive.

Petrochemicals, such as chlorinated hydrocarbons and olefin plant fluids, such as deethanizer bottoms, are also subjected to corrosive attack of halide containing acids both during the product storage and shipment steps as well as during the heat treatment steps employed in petrochemical synthesis, product isolation and purification. For example, in the manufacture of vinyl resins, such as poly(vinyl)chloride, ethylenedichloride (EDC) hydrocarbon is commonly dehydrochlorinated over a barium catalyst at about 500° C. (932° F.) to form the desired PVC product. However, chlorides present in the EDC charge or those produced as a by-product in the PVC synthesis can cause severe corrosion of distillation equipment, heat exchangers and product recovery equipment.

Accordingly, there is a need in the art to provide an effective halide scavenger that is capable of reducing the halide content of petroleum feedstocks and petrochemicals both during the shipment and storage stages of same as well as during the heat processing thereof (such as at temperatures of from about 100° F. to 1000° F., more particularly 200° F.–1000° F.) to minimize the deleterious corrosive effects of the halides in such mediums.

SUMMARY OF THE INVENTION

This and other objects of the invention are met by the use of active alcohols that are added to a liquid hydrocarbonaceous medium of the type prone to halide-based corrosion. As used herein, the phrase "active alcohols" signifies an alcohol that will react with the particular hydrogen halide corrosive at room temperature without the aid of a catalyst. Suitable active alcohols include benzyl alcohol, allyl alcohol and tertiary alcohols, such as tert-butyl alcohol.

As used herein, the phrase "liquid hydrocarbonaceous medium" signifies various and sundry petroleum hydrocarbon and petrochemicals. For instance, petroleum hydrocarbons such as petroleum hydrocarbon feedstocks including crude oils and fractions thereof such as naphtha, gasoline, kerosene, diesel, jet fuel, fuel oil, gas oil, vacuum residual, etc., may all be benefitted by using the treatments herein disclosed and claimed.

Similarly, petrochemicals such as olefinic or naphthenic process streams, ethylene glycol, aromatic hydrocarbons and their derivatives may all be successfully treated using the inventive treatments herein described and claimed and are within the ambit of the phrase "liquid hydrocarbon aqueous medium" as used herein.

From about 1–10,000 ppm of such active alcohols are added to the particular liquid hydrocarbonaceous medium for which such halide scavenging is desired, with a more preferred range of addition being about 1–1500 ppm based upon one million parts of the liquid hydrocarbon.

PRIOR ART

Traditionally, attempts to minimize the problems caused by halide-based corrosion have involved the addition of amines and amides to the hydrocarbon medium. These treatments, in most cases, form salts that are less corrosive than the hydrogen halides but which are still corrosive in their own right. Typical of such amine treatments is (Stedman) U.S. Pat. No. 3,779,905.

In U.S. Pat. No. 2,415,161 (Camp), various low boiling alcohols, such as methyl, ethyl, propyl, butyl and amyl alcohol are used to inhibit corrosion of ferrous metals in processes in which hydrocarbons are contacted in vapor phase at high temperatures with such metals. This disclosure, although generally directed toward corrosion prevention, is not specifically directed toward the particular corrosive source, namely, hydrogen halide corrosion, that is dealt with herein.

The use of allyl and sundry other alcohols (Column 6, lines 54–66) in coating compositions to coat metals to inhibit corrosion is taught in U.S. Pat. No. 2,509,785 (Schiermeier et al). Acetylenic alcohols are taught to inhibit acid corrosion of ferrous metals in (Pumpelly et al) U.S. Pat. Nos. 2,913,408 and (Monroe et al) U.S. Pat. No. 2,993,863 (Monroe et al). Of somewhat similar import is (Berger et al) U.S. Pat. No. 2,603,622 which discloses using acetylenic alcohols to inhibit acid-based corrosion found in plastic masses.

The use of certain phenolates to reduce or eliminate corrosion in coal liquid fractionation towers is discussed in (Baumert et al) U.S. Pat. No. 4,511,453.

Other patents which may be of interest are (Hudson et al) U.S. Pat No. 3,310,497; (Foroulis) U.S. Pat. No. 3,413,237; and (Baumert et al) U.S. Pat. No. 4,514,281.

Despite the prior art efforts, there remains a need in the art for an effective hydrogen halide scavenger that is effective in reducing hydrogen halide content in liquid hydrocarbonaceous mediums at room temperature and even during the high temperature processing of same during refinery operations, synthesis, product recovery and/or purification stages.

DETAILED DESCRIPTION OF THE PREFERRED EMBODIMENT

In accordance with the invention, from about 1–10,000 ppm of an active alcohol is added to the desired liquid hydrocarbonaceous medium comprising corrosive hydrogen halide species therein. The active alcohols can be used at ambient temperature so that they minimize halide-based corrosion of the liquid hydrocarbonaceous medium during shipment or storage or they can be added to the liquid hydrocarbonaceous medium either before or during high temperature treatment thereof in accordance with conventional refinery or petrochemical techniques.

For example, with respect to refinery and petrochemical distillation and heat treatment processes generally, the active alcohols may be injected into the charge itself, the overhead lines, or the reflux lines of the system. In refinery systems, it is preferred to feed the active alcohol directly into the feedstock so as to prevent the deleterious entrance of the corrosive hydrogen halide, HCl, into the overhead lines as much as possible.

Although applicant is not to be bound to any particular theory of operation, it is thought that the active alcohol compound chemically reacts with the halide species present in the hydrocarbon medium in accordance with the following $$ROH + HX \rightarrow RX\ H_2O$$

wherein X is a halogen. The organic halide thus formed would partition to the organic phase of the liquid hydrocarbon and would not migrate to the aqueous phase where halide contamination has caused severe problems. (See for instance the discussion of the problem in U.S. Pat. No. 4,430,196—of common assignment herewith.)

Exemplary Active Alcohols include:

benzyl alcohol
tert-butyl alcohol
allyl alcohol
tert-pentyl alcohol
tri-ethyl carbinol
tri-phenyl carbinol
2-ethyl butanol Preferred active alcohols include allyl alcohol, benzyl alcohol and tertiary alcohols of the formula

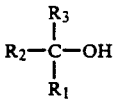

wherein $R_1$, $R_2$, and $R_3$ are the same or different and are chosen from the group of $C_1$–$C_6$ alkyl, $C_1$–$C_6$ alkenyl, or $C_1$–$C_6$ alkynyl or phenyl. The most preferred tertiary alcohol is tert-butyl alcohol.

Although the invention is applicable to a myriad of different types of liquid hydrocarbons, it shows particular promise as a HCl scavenger in ethylene dichloride product and heat treatment processes thereof such as those are adapted to produce vinyl resins. For example, the active alcohol may be fed to an ethylene dichloride reactant batch adapted to undergo dehydrochlorination by the Wulff process or other processes to form poly(vinyl chloride).

The active alcohols may be used neat or they may be dissolved in a suitable solvent or dispersed in a suitable carrier liquid. Suitable solvents may, for comprise water or non-polar solvents such as heavy aromatic naphtha.

EXAMPLES

The invention is further illustrated by the following examples which are intended solely for the purpose of illustration and are not to be regarded as limiting the scope of the invention or the manner in which it is to be practiced.

EXAMPLE 1

Hydrogen chloride (HCl) was added to xylene until a 0.7% (wt%) HCl concentration was present. 20.0 (wt.%) and 1.8 wt.%), respectively, of benzyl alcohol were then added to the solution with the amount of benzyl chloride produced being monitored in each instance. The concentration of benzyl chloride recovered in the two test runs represented an 86% and 71% reduction in the amount of HCl present in the xylene solution.

EXAMPLE 2

Procedure similar to example 1 was utilized except that ethylene dichloride (EDC) was used as the hydrocarbon medium instead of xylene. At the beginning of the test, the HCl concentration in the EDC solution was 600 ppm. 2000 ppm of benzyl alcohol were added to the solution and, after a ten-minute period of time, the amount of benzyl chloride produced was monitored and found to represent an 84% reduction in the HCl concentration of the EDC Solution.

EXAMPLE 3

The ability of benzyl alcohol to scavenge HCl produced in situ was measured in this example. HCl was generated in situ in an EDC solution by reacting the EDC with aluminum. Benzyl alcohol in an amount of 1000 ppm was added to the EDC solution with the amount of HCl generated in the test solution being measured at 60 ppm. During the test, the amount of benzyl chloride produced was measured and accounted for the equivalent production of 45 ppm HCl. This represents a 75% reduction in HCl produced by use of the benzyl alcohol chloride scavenger. A control test was run with no benzyl chloride being produced by the control.

EXAMPLE 4

A 90% hydrocarbon (20% aromatic-80% heptane)-L-10% water solution was spiked with 37 ppm HCl and 1000 ppm benzyl alcohol. Based upon the amount of benzyl chloride produced, the HCl concentration was reduced by about 20%.

EXAMPLE 5

Several tests similar to example 4 were conducted with the exception that varying amounts of tertiary butyl alcohol were added as the candidate chloride scavenger. As shown in the following table, efficacy ranged from 30% to 59% HCl reduction.

TABLE

| ppm tertiary butyl alcohol added to liquid hydrocarbon | % reduction in HCl |
|---|---|
| 9000 ppm | 59% |
| 1000 ppm | 41% |
| 500 ppm | 38% |

EXAMPLE 6

Two test similar to Example 4 were conducted with exception that varying amounts of allyl alcohol were added as the chloride scavenger. When 1000 ppm allyl alcohol was used, the HCl concentration was reduced by about 64%. Where 500 ppm allyl alcohol was added the HCl concentration was reduced by about 39%.

DISCUSSION

In accordance with the above, it can be seen that benzyl alcohol, tertiary butyl alcohol and allyl alcohol are all effective in reducing the HCl content of hydrocarbonaceous liquid mediums containing same.

Based upon presently available experimental data, it is preferred to utilize a product containing benzyl alcohol dissolved in a heavy aromatic naphtha hydrocarton medium in a ratio of about 1:3 (based upon weight).

While this invention has been described with respect to particular embodiments thereof, numerous other forms and modifications of this invention will become apparent to those skilled in the art. The appended claims and this invention generally should be construed to cover such other forms and modifications of the present invention.

We claim:

1. A method for scavenging hydrogen halide species from a liquid hydrocarbonaceous medium comprising an organic phase component and an aqueous phase component, said medium containing such hydrogen halide species, said method comprising adding an effective amount for the purpose of an active alcohol to said medium, said active alcohol reacting with said hydrogen halide species to yield an organic halide that partitions to said organic phase said active alcohol comprising a member selected from the group consisting of allyl alcohol, benzyl alcohol, and tertiary alcohols of the formula

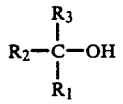

wherein $R_1$, $R_2$, and $R_3$ are the same or different and are chosen from $C_1$–$C_6$ alkyl, $C_1$–$C_6$ alkenyl, $C_1$–$C_6$ alkynyl, and phenyl.

2. A method as recited in claim 1 comprising adding from about 1 to 10,000 parts of said active alcohol to said liquid hydrocarbonaceous medium based upon one million parts of said medium.

3. A method as recited in claim 2 comprising adding from about 1 to 1500 parts of said active alcohol.

4. A method as recited in claim 3 further comprising heating said medium to a temperature of from about 100–1100°F.

5. A method as recited in claim 4 comprising heating said medium to a temperature of from about 400° F.–1000° F.

6. A method as recited in claim 1 wherein said medium comprises a petroleum refinery feedstock and wherein said hydrogen halide species comprises HCl.

7. A method as recited in claim 6 wherein said petroleum feedstock is distilled at temperatures of from about 100°–1100° F. to provide a plurality of hydrocarbon distillation fractions.

8. A method as recited in claim 1 wherein said active alcohol comprises benzyl alcohol.

9. A method as recited in claim 1 wherein said active alcohol comprises allyl alcohol.

10. A method as recited in claim 1 wherein said active alcohol comprises tert-butyl alcohol.

11. A method as recited in claim 1 wherein said medium comprises a petrochemical and wherein said hydrogen halide species comprises HCl.

12. A method as recited in claim 11 wherein said petrochemical comprises ethylene dichloride.

13. A method as recited in claim 12 wherein said ethylene dichloride is heated to a temperature of from about 100–1000°F.

14. A method as recited in claim 13 wherein said active alcohol comprises benzyl alcohol.

15. A method as recited in claim 13 wherein said active alcohol comprises allyl alcohol.

16. A method as recited in claim 13 wherein said active alcohol comprises tert-butyl alcohol.

* * * * *